US005898963A

United States Patent [19]

Larson

[11] Patent Number: 5,898,963

[45] Date of Patent: May 4, 1999

[54] ADJUSTABLE SUPPORT CERVICAL PILLOW

[76] Inventor: Lynn D. Larson, 5410 NW. 44th St., Lincoln, Nebr. 68524

[21] Appl. No.: 09/114,647

[22] Filed: Jul. 13, 1998

[51] Int. Cl.[6] ..... A47G 9/00

[52] U.S. Cl. ..... 5/644; 5/645; 5/640; 5/708

[58] Field of Search ..... 5/636, 640, 644, 5/645, 708

[56] References Cited

U.S. PATENT DOCUMENTS

| | | | |
|---|---|---|---|
| 2,896,227 | 6/1959 | Reed | 5/644 |
| 3,042,941 | 7/1962 | Marcus | 5/708 |
| 4,501,034 | 2/1985 | Greenawalt | 5/644 |
| 4,829,614 | 5/1989 | Harper | 5/644 |
| 5,632,055 | 5/1997 | Graf | 5/708 X |

FOREIGN PATENT DOCUMENTS

| | | | |
|---|---|---|---|
| 2194883 | 3/1988 | United Kingdom | 5/640 |

*Primary Examiner*—Michael F. Trettel
*Attorney, Agent, or Firm*—Zarley, McKee, Thomte Voorhees & Sease; Dennis L. Thomte

[57] ABSTRACT

The cervical pillow of the present invention includes an elongated air tight casing with a resilient cushion mounted at one side thereof. An inlet valve in the casing permits air flow into the cushion portion. A conduit extending from the cushion portion into an air chamber in the remainder of the cervical pillow permits air flow into the air chamber. An electric pump is mounted within the cushion to pump air into the air chamber, and thereby pressurize the cervical pillow. A relief valve is mounted in one end of the air chamber to permit selective release of air from the air chamber. A cervical pillow is attached to a standard head support pillow along a longitudinal side of both pillows.

6 Claims, 1 Drawing Sheet

ADJUSTABLE SUPPORT CERVICAL PILLOW

TECHNICAL FIELD

The present invention relates generally to pillows, and more particularly to an improved cervical pillow with an inflatable air chamber to provide adjustable support.

BACKGROUND OF THE INVENTION

Pillows for the support of the back of the neck, or cervix have proliferated in the past few years. Most such cervical pillows are utilized in conjunction with a standard size pillow used for supporting the head.

The major drawback of prior art cervical pillows is in the fact that the support provided by the pillow is not adjustable. Thus, a pillow with firmer support or greater height may be more comfortable when the user is laying on his or her side, while less firm support or less height is desired when the user is lying on his or her back. Currently, the situation would require two separate pillows of different firmness or heights to provide the desired comfort.

SUMMARY OF THE INVENTION

It is therefore a general object of the present invention to provide a cervical pillow with adjustable support.

Another object is to provide an adjustable cervical pillow connected to a standard pillow.

Still another object of the present invention is to provide a combination standard and cervical pillow which are each adjustable in firmness.

These and other objects of the present invention will be apparent to those skilled in the art.

The cervical pillow of the present invention includes an elongated air tight casing with a resilient cushion mounted in the rearward end. An inlet valve in the rearward end of the casing permits air flow into the cushion portion. A conduit extending from the cushion portion into an air chamber in the remainder of the cervical pillow permits air flow into the air chamber. An electric pump is mounted within the cushion to pump air into the air chamber, and thereby pressurize the cervical pillow. A relief valve is mounted in one end of the air chamber to permit selective release of air from the air chamber. A cervical pillow is attached to a standard head support pillow along a longitudinal side of both pillows.

DESCRIPTION OF THE PREFERRED EMBODIMENT

Figure 1:
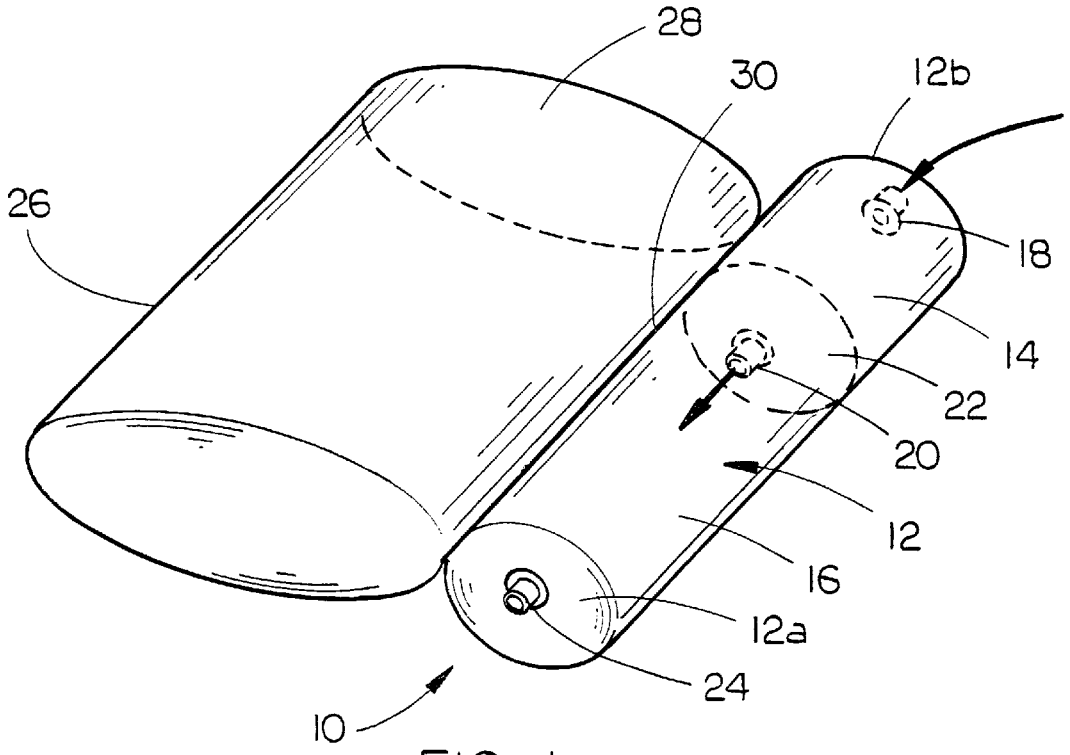
FIG. 1 is a perspective view of the adjustable cervical pillow of the present invention.

Referring now to the drawings, in which similar or corresponding parts are identified with the same reference numeral, and more particularly to FIG. 1, the adjustable support cervical pillow of the present invention is designated generally at 10 and includes a generally cylindrical fabric casing 12 having first and second sides 12*a* and 12*b*, respectively. Casing 12 preferably has a cylindrical polyurethane foam cushion 14 mounted therein adjacent side 12*b* thereof, although cushion 14 could be located at other locations in casing 12 depending upon the desired location of the air pump, as will be described hereinafter.

Casing 12 is preferably air tight to form an air bladder, and includes an air chamber 16 extending laterally from cushion 14 towards side 12*a* of casing 12. A one-way inlet valve 18 is mounted in casing 12 and installed in cushion 14, to selectively permit air flow into the casing 12 and air chamber 16. A small air pump 20 may be provided within cushion 14 to pump air from inlet 18 into air chamber 16, the inner end of cushion 14 having a sealed wall 22 separating cushion 14 from air chamber 16. Pump 20 may be located at either end of cushion 14 or could be located adjacent the top or bottom portions thereof if so desired. Further, the pump 20 could be replaced with a needle valve arrangement if so desired.

A relief valve 24 is mounted in the side 12*a* of casing 12 and air chamber 16 to selectively adjust the air pressure within air chamber 16, and thereby adjust the firmness or support (height) provided by cervical pillow 10.

A standard pillow 26 is filled with a resilient material 28 of a type desired by the consumer. Resilient material 28 may include down, polyurethane foam, or fibrous batting, depending upon the needs of the end user. Standard pillow 26 is attached along a longitudinal side 30 to a longitudinal side of cervical pillow 10.

In operation, the end user may inflate cervical pillow 10 to the air pressure desired to provide the support (firmness or height) needed on the cervix of the user. Cervical pillow 10 can be manually inflated, or air pump 20 may be utilized to inflate air chamber 16. Relief valve 24 may be opened to reduce the air pressure within air chamber 16 and thereby "soften" (decrease the height) cervical pillow 10.

Figure 2:
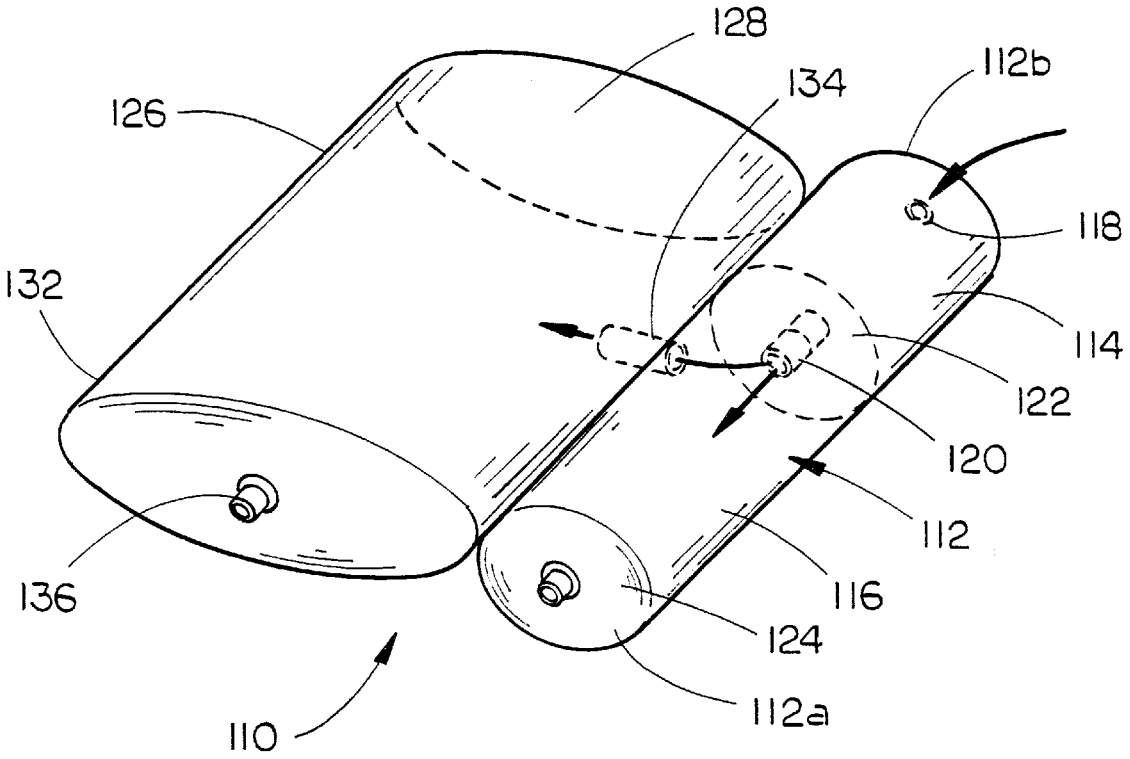
FIG. 2 is a perspective view similar to FIG. 1, but showing a second embodiment of the invention.

Referring now to FIG. 2, a second embodiment of the cervical pillow is designated generally at 110 and includes the same casing 112 with cushion 114, air chamber 116, air inlet valve 118, air pump 120, sealed wall 122 and relief valve 124 as the first embodiment of the invention. The cervical pillow 110 of the second embodiment differs from the first embodiment in the use of an air tight casing 32 to retain the resilient material 128 within the standard pillow 126. In this case, the "standard" pillow 126 is intended to mean a pillow of standard size with standard resilient material 128 therein.

In addition, a one-way valve 134 permits air to flow from cervical pillow air chamber 1 16 into the air tight casing 132 of standard pillow 126. A relief valve 136 is provided in the side of standard pillow 126 to permit the adjustment of the pressure of the standard pillow 126 by the user.

In use, the cushion 114 will retain air pump 120 and inlet valve 118 and prevent the user from feeling these rigid objects, since they are embedded within the cushion 114. The air chamber 116 of casing 112 is inflated with air pump 120, and casing 132 of standard pillow 126 is simultaneously inflated by virtue of valve 134. Because valve 134 is a one-way valve, both the standard pillow 126 and casing 112 are initially inflated to the same pressure. Relief valve 124 in the end of casing 112 may then be opened to reduce the pressure in the casing 112, to provide the desired support for the user's neck. Thus, casing 112 may be inflated at a lower pressure than the standard pillow 126. The support provided by pillow 126 may also be adjusted by selectively opening relief valve 136 therein.

Whereas the invention has been shown and described in connection with the preferred embodiment thereof, many modifications, substitutions and additions may be made which are within the intended broad scope of the appended claims.

I claim:

1. A cervical pillow with adjustable support, comprising:

an elongated air tight casing having first and second sides, a longitudinal side, and an interior;

a resilient cushion mounted in the first side of the casing and extending inwardly to a wall defining a first air chamber sealing the cushion in the first air chamber, separate from the second side of the casing and forming a second air chamber extending from the wall to the second side of the casing;

an operable inlet valve in said first side of the casing selectively permitting air flow into said first air chamber;

an air conduit extending from the first air chamber, through the wall, into the second air chamber, to permit unidirectional air transfer into the second air chamber; and a head support pillow filled with resilient material attached along a longitudinal side to a longitudinal side of the cervical pillow.

2. The cervical pillow of claim 1, further comprising a relief valve in the second side of the cervical pillow casing, selectively operable to permit air flow out of the second air chamber in the cervical pillow casing.

3. The cervical pillow of claim 2, further comprising an operable discrete air pump mounted in the cushion and connected to the conduit to selectively draw air in through the inlet valve and pump the air into the second air chamber.

4. The cervical pillow of claim 3, wherein the head support pillow includes an air tight casing, and further comprising a valve between the head support pillow casing and the cervical pillow casing, to permit air flow therebetween.

5. The cervical pillow of claim 4, wherein said valve between the head support pillow casing and cervical pillow casing is a one-way valve permitting air flow only from the cervical pillow to the head support pillow, and further comprising a relief valve operably mounted in the head support pillow casing to selectively release air therefrom.

6. The cervical pillow of claim 1, further comprising an operable discrete air pump mounted in the cushion and connected to the conduit to selectively draw air in through the inlet valve and pump the air into the second air chamber.

* * * * *